US007934597B2

(12) United States Patent
Zwick et al.

(10) Patent No.: US 7,934,597 B2
(45) Date of Patent: May 3, 2011

(54) TISSUE PRODUCT WITH SACRIFICIAL TOP SHEET FOR POP-UP DISPENSING

(75) Inventors: Kenneth John Zwick, Neenah, WI (US); Mark Anthony Barnes, Neenah, WI (US); Dennis Edward Fryer, Ashford (GB); Cynthia Watts Henderson, Neenah, WI (US); Leslie Thomas Long, Appleton, WI (US); Paul Kerner Pauling, Appleton, WI (US); Bart John Rabas, Appleton, WI (US); Stephanie Marie Stoddart, Bentoville, AR (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 12/647,762

(22) Filed: Dec. 28, 2009

(65) Prior Publication Data

US 2010/0224513 A1 Sep. 9, 2010

Related U.S. Application Data

(60) Provisional application No. 61/157,014, filed on Mar. 3, 2009.

(51) Int. Cl.
*B65D 71/00* (2006.01)

(52) U.S. Cl. ..... 206/233; 206/494; 221/50; 221/210

(58) Field of Classification Search ..... 206/207, 206/210, 205, 494, 581, 812, 233; 221/37, 221/33, 45, 47, 48, 50, 210
See application file for complete search history.

(56) References Cited

U.S. PATENT DOCUMENTS

| | | | | |
|---|---|---|---|---|
| 2,071,981 | A | 12/1936 | Landsiedel | |
| 3,066,932 | A | 12/1962 | Greiner et al. | |
| 3,401,927 | A | 9/1968 | Frick et al. | |
| 4,574,952 | A * | 3/1986 | Masui | 206/494 |
| 5,520,308 | A * | 5/1996 | Berg et al. | 221/50 |
| 6,182,418 | B1 | 2/2001 | McFarland | |
| 6,202,392 | B1 | 3/2001 | Greenwell et al. | |
| 6,238,328 | B1 | 5/2001 | Loppnow et al. | |
| 6,715,633 | B2 | 4/2004 | Thoms | |
| 6,817,484 | B2 | 11/2004 | Morin et al. | |
| 7,073,310 | B1 | 7/2006 | Long et al. | |
| 7,097,896 | B2 * | 8/2006 | Merrill | 428/126 |
| 7,398,629 | B2 | 7/2008 | Long et al. | |
| 7,661,552 | B2 | 2/2010 | Baum et al. | |
| 7,661,554 | B2 | 2/2010 | Szymonski et al. | |
| 7,785,443 | B2 * | 8/2010 | Hermans et al. | 162/168.1 |
| 2003/0062376 | A1 | 4/2003 | Sears et al. | |
| 2005/0258062 | A1 * | 11/2005 | Bando | 206/494 |
| 2006/0093788 | A1 * | 5/2006 | Behm et al. | 428/137 |
| 2007/0045335 | A1 | 3/2007 | Szymonski et al. | |
| 2007/0130891 | A1 | 6/2007 | Long et al. | |
| 2010/0102077 | A1 | 4/2010 | Szymonski et al. | |

* cited by examiner

*Primary Examiner* — Jacob K Ackun, Jr.
(74) *Attorney, Agent, or Firm* — Michael J. Sullivan; Gregory E. Croft

(57) ABSTRACT

In order to improve the reliability of cleanly dispensing the first tissue in a pop-up dispensing tissue container, a relatively high strength sacrificial top sheet is interfolded with the tissue clip. The sacrificial top sheet is adhered to the underside of a removable surfboard in the top of the container, such that when the surfboard is removed to access the tissues, the sacrificial sheet is simultaneously removed, which causes the first tissue to pop up into a ready position for subsequent dispensing by the user.

12 Claims, 4 Drawing Sheets

TISSUE PRODUCT WITH SACRIFICIAL TOP SHEET FOR POP-UP DISPENSING

This application claims priority from presently copending U.S. Provisional Application No. 61/157,014 entitled "Tissue Product with Sacrificial Top Sheet for Pop-Up Dispensing" filed on Mar. 3, 2009, in the names of Kenneth John Zwick et al.

BACKGROUND OF THE INVENTION

Dispensing the first sheet from a pop-up style facial tissue carton can be difficult because the consumer must remove the cardboard cut-out (surf board) from the top of the carton, pry open the slit in the underlying polymer film that covers the interfolded stack of tissues within the carton, reach inside the carton to locate the edge of the first tissue sheet and then carefully pull out the top sheet. It is often difficult to find and grasp only the edge of the top sheet and the top sheet frequently tears. Frequently multiple sheets are withdrawn or the top sheet tears during removal, which is common basis for consumer complaints for facial tissue products. In some facial products, the first two sheets of the interfolded stack (clip) are doubled together to minimize tearing during the initial dispensing of the carton. Recently, others have proposed adhering the top sheet to the carton lid or surf board to automatically dispense the top sheet upon opening the carton. Such arrangements are disclosed in commonly-assigned co-pending patent application US 2007/0045335 A1 entitled "Tissue Sheet Container and Process for Making Same", published Mar. 1, 2007 by Szymonski et al., and U.S. Pat. No. 6,715,633 entitled "Interfolded Sheet Container Having a Starter Sheet Pull-Out System" issued Apr. 6, 2004, to Thoms, both of which are hereby incorporated by reference. Although this approach is effective for initiating pop-up dispensing, this arrangement can tear and damage the top sheet, which can be annoying to the consumer. Additionally, some consumers are further annoyed by wasting an otherwise usable top sheet.

SUMMARY OF THE INVENTION

It has now been discovered that pop-up tissue dispensing can be improved by making the top sheet within the interfolded stack of tissues a "sacrificial" sheet which is interfolded with the tissue below it and adhered to the surf board of the tissue carton. The sacrificial sheet, which can be a tissue sheet or another kind of sheet, has a substantially higher geometric mean tensile strength than the tissues within the stack intended for use. As a result, the sacrificial top sheet is removed with the surf board when the tissue carton is opened, while at the same time partially removing the underlying tissue through the dispensing opening.

Hence in one aspect, the invention resides in a tissue product comprising a clip of interfolded tissues within a container, said container having a top through which the tissues are withdrawn by a user, said top comprising a pop-up tissue dispensing opening and a detachable surfboard overlaying the dispensing opening, said clip of interfolded tissues having an interfolded sacrificial top sheet adhered to the surfboard, said top sheet having a geometric mean tensile strength substantially greater than the geometric mean tensile strength of the tissues within the clip, wherein upon removal of the surfboard by the user, the sacrificial top sheet is also removed. More specifically, the geometric mean tensile strength of the sacrificial top sheet can be greater than the geometric mean tensile strength of the tissues within the clip by about 5 percent or more, more specifically about 10 percent or more, more specifically about 20 percent or more, more specifically from about 5 to about 2500 percent, more specifically from about 10 to about 2500 percent, and still more specifically from about 20 to about 2500 percent. The increased level of strength of the sacrificial top sheet relative to that of the tissues within the clip will depend in part upon the strength of the tissues, the strength of the sacrificial top sheet needed to dispense without tearing and the intended secondary use of the sacrificial top sheet, if any.

Optionally, the top of the container comprises a poly film having a dispensing opening therein, such as a slit or other narrow opening, which are common and readily commercially available. However, the tissue products of this invention also include tissue containers without a poly film, such as those described in U.S. Pat. No. 6,817,484 entitled "Container for a Stack of Interfolded Tissue Sheets and a Method for Manufacturing Such a Container", issued Nov. 16, 2004 to Morin et al., which is hereby incorporated by reference.

Suitable sacrificial top sheets include sheets comprising cellulosic materials, such as tissue or paper sheets, or synthetic materials, such as nonwoven sheets or plastic films. Regardless of the chosen material for the sacrificial sheet, the geometric mean tensile strength (GMT) of the sacrificial top sheet of the interfolded stack of tissues in accordance with this invention can be about 1000 grams or greater per 3 inches of width, more specifically from about 1000 to about 20,000 grams per 3 inches of width, more specifically from about 1500 to about 15,000 grams per 3 inches of width, and still more specifically from about 2000 to about 15,000 grams per 3 inches of width. In contrast, usable facial tissues typically have a geometric mean tensile strength of about 800 grams per 3 inches of width. If the sacrificial top sheet is a tissue sheet, the strength of the sheet can be increased with the use of conventional dry strength agents or heavy refining during manufacturing. If the sacrificial top sheet is manufactured with the other tissue sheets within the clip, it can be separately sprayed with starch, for example, to selectively increase its strength.

The sacrificial top sheet can easily be integrated with the tissue clip using conventional commercial converting methods. For example, the sacrificial top sheet can be unwound from a roll of the sacrificial top sheet material and positioned as the first sheet in a multi-folder process, such as that disclosed in U.S. Pat. No. 3,066,932 entitled "Paper Folding Machine and Method", issued Dec. 4, 1962 to Greiner et al., which is hereby incorporated by reference. A starter sheet folding board (such as that disclosed in U.S. Pat. No. 6,238,328 entitled "Folding Device", issued May 9, 2001 to Loppnow et al., which is hereby incorporated by reference) can also advantageously be used in the multi-folder process. The starter sheet folding board causes a folded edge to occur on the top of the stack of sheets, which could be aligned underneath the detachable surfboard opening of the carton.

The sacrificial top sheet can be visually distinct from the tissues within the clip so that the user does not mistake the sacrificial top sheet for a wasted usable tissue. As used herein, "visually distinct" means that an ordinary user of the tissue product would readily recognize a difference in the visual appearance of the top sheet as compared to the visual appearance of the usable tissues within the container. Suitable visual differences include, without limitation, differences in size, color or the presence of printed matter (shapes, graphics, designs, words, etc.). In some embodiments, the sacrificial top sheet can have an additional or secondary utility. For example, in one specific embodiment, the sacrificial top sheet can be a coupon. In other specific embodiments, the sacrificial top sheet can contain advertising, consumer tips to manage colds and allergies, instructions, suggestions for different uses for the tissues and/or the carton, an uplifting message, and the like.

For purposes herein, the "geometric mean tensile strength" is the square root of the product of the machine direction tensile strength multiplied by the cross-machine direction tensile strength. The "machine direction (MD) tensile strength" is the peak load (grams-force) per 3 inches (76.2 mm) of sample width when a sample is pulled to rupture in the machine direction. Similarly, the "cross-machine direction (CD) tensile strength" is the peak load per 3 inches (76.2 mm) of sample width when a sample is pulled to rupture in the cross-machine direction. The procedure for measuring tensile strength is as follows.

Samples for tensile strength testing are prepared by cutting a 3 inches (76.2 mm) wide by 5 inches (127 mm) long strip using a JDC Precision Sample Cutter (Thwing-Albert Instrument Company, Philadelphia, Pa., Model No. JDC 3-10, Serial No. 37333). The instrument used for measuring tensile strengths is an MTS Systems Insight 1 Material Testing Work Station. The data acquisition software is MTS TestWorks® 4 (MTS Systems Corp., 14000 Technology Driver, Eden Prairie, Minn. 55344). The load cell is selected from either a 50 Newton or 100 Newton maximum (S-Beam TEDS ID Load Cell), depending on the strength of the sample being tested, such that the majority of peak load values fall between 10-90% of the load cell's full scale value. The gauge length between jaws is 4±0.04 inches (101.6±1 mm). The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65%. The data is recorded at 100 hz. The sample is placed in the jaws of the instrument, centered both vertically and horizontally. The test is then started and ends when the specimen breaks. The peak load is recorded as the "tensile strength" of the specimen. At least six (6) representative specimens are tested for each product or sheet, taken "as is", and the arithmetic average of all individual specimen tests is either the MD or CD tensile strength for the product or sheet.

The sacrificial top sheet can be adhered to the surfboard using any suitable adhesive which can adhere the sacrificial top sheet to the surfboard and maintain attachment until after the surfboard is removed from the container or carton. Particularly suitable adhesives include hot melt or pressure sensitive adhesives. Examples of suitable commercially available adhesives include, without limitation, Bostik HMY-1505, Bostik H1714, Bostik L 1232 and Bostik L7195, all available from Bostik, Inc., 11320 Watertown Plank Rd, Wauwatosa, Wis. 53226. If the dispensing opening in the poly film is a slit, a portion of the slit needs to be widened in order to enable the adhesive deposit on the underside of the surfboard to contact and adhere to the sacrificial top sheet in the clip.

The amount of adhesive that is applied to the removable panel may also vary depending upon various factors including the type of adhesive material used and the extent to which bonding is desired between the removable panel and the disposable sheet. For example, the adhesive material may be present in an amount of about 0.5 gram or less, more specifically about 0.1 gram or less, more specifically about 0.05 gram or less, and still more specifically from about 0.01 gram to about 0.04 gram.

Suitably, in a commercial setting, the adhesive can be applied to the sacrificial top sheet in the cartoner process utilized to place the clip of sheets into the carton. Suitable cartoner processes include, without limitation, those described in the following: U.S. Pat. No. 6,202,392 B1 entitled "Flexible Tissue Handling Apparatus" issued Mar. 20, 2001 to Greenwell et al.; U.S. Pat. No. 7,073,310 B1 entitled "Flexible Carton Loading Apparatus" issued Jul. 11, 2006 to Long et al.; and US 2007/0130891 A1 entitled "Vertical Carton Loading Process and System For Clips of a Stacked Sheet Material", published Jun. 14, 2007 by Long et al., all of which are hereby incorporated by reference. In one embodiment, the adhesive can be applied to the inside of the surfboard portion of the carton just before the tissue clip is transferred into the carton. At the cartoner exit, the filled carton can be rotated top down to allow the sacrificial top sheet to drop down and contact the adhesive on the surfboard of the carton.

In the interests of brevity and conciseness, any ranges of values set forth in this specification contemplate all values within the range and are to be construed as written description support for claims reciting any sub-ranges having endpoints which are whole number or otherwise of like numerical values within the specified range in question. By way of a hypothetical illustrative example, a disclosure in this specification of a range of from 1 to 5 shall be considered to support claims to any of the following ranges: 1-5; 1-4; 1-3; 1-2; 2-5; 2-4; 2-3; 3-5; 3-4; and 4-5. Similarly, a disclosure in this specification of a range from 0.1 to 0.5 shall be considered to support claims to any of the following ranges: 0.1-0.5; 0.1-0.4; 0.1-0.3; 0.1-0.2; 0.2-0.5; 0.2-0.4; 0.2-0.3; 0.3-0.5; 0.3-0.4; and 0.4-0.5. In addition, any values prefaced by the word "about" are to be construed as written description support for the value itself. By way of example, a range of "from about 1 to about 5" is to be interpreted as also disclosing and providing support for a range of "from 1 to 5", "from 1 to about 5" and "from about 1 to 5".

DETAILED DESCRIPTION OF THE DRAWINGS

Figure 1:
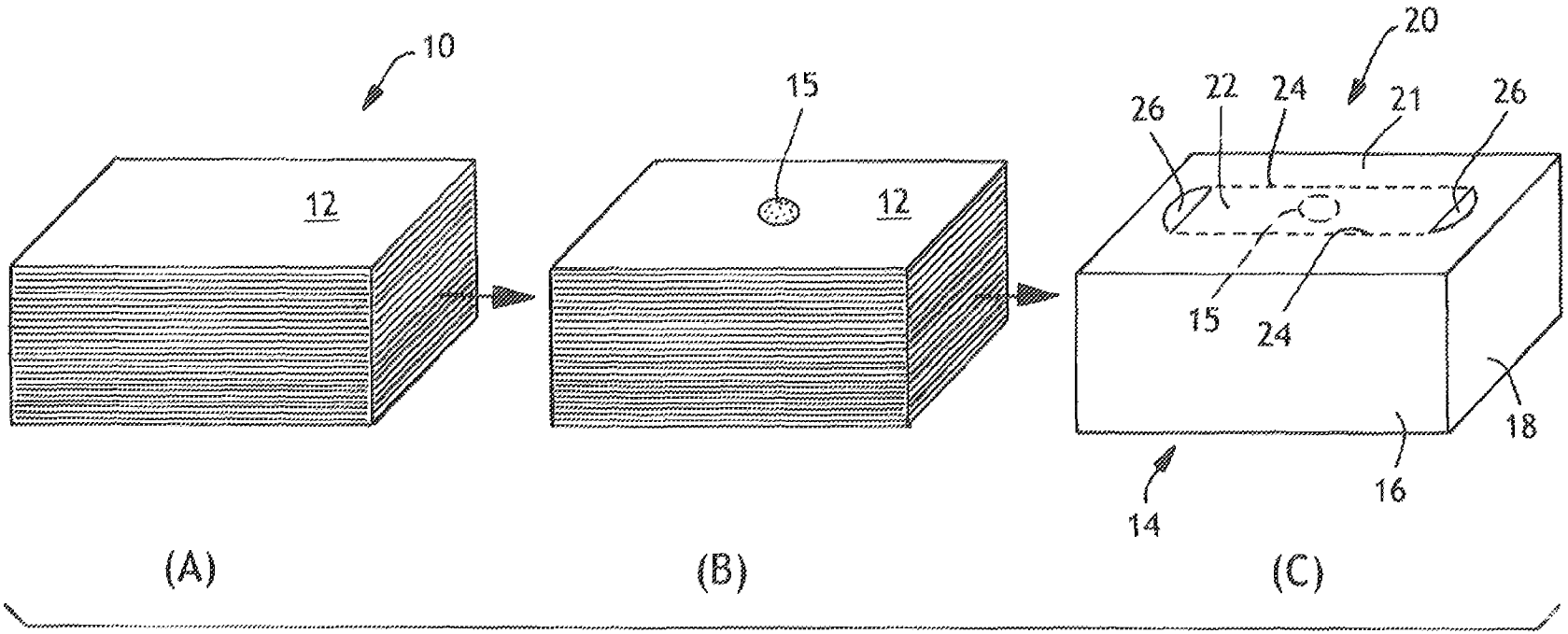
FIG. 1 is a schematic illustration of one embodiment of a method of making a product of this invention, showing the deposition of a dot of adhesive onto the sacrificial top sheet of a clip or stack of tissues, which is then inserted into a tissue container.

Reference will now be made in detail to embodiments of the invention, one or more examples of which are illustrated in the drawings. Each example is provided by way of explanation of the invention, and is not meant as a limitation of the invention. For example, features illustrated or described as part of one embodiment can be used with another embodiment to yield still a third embodiment. It is intended that the present invention includes these and other modifications and variations. Repeat use of reference characters in this present specification and drawings is intended to represent same or analogous features or elements.

In general, the invention is directed to a product comprising a container for pop-up dispensing which contains a stack of interfolded disposable sheets. The disposable sheets can be, for instance, facial tissues, paper towels, industrial wipers, laboratory wipers, wet wipes, and the like. The dispensing container includes a removable panel that, once removed, uncovers a dispensing opening for withdrawing the sheets from the container in a pop-up fashion. Particularly suitable dispensing openings include slits or similarly-shaped narrow openings in a plastic film that otherwise covers the larger opening created by the absence of the removable panel. The removable panel is adhesively attached to a sacrificial top sheet in the stack of sheets so that upon removal of the removable panel, the sacrificial top sheet in the stack is also completely removed. The adhesive material can be applied to the sacrificial top sheet of the stack prior to inserting the stack into the container so that the adhesive material is available for attachment to the removable panel upon contact. Alternatively, the adhesive material can be applied to a recess in the removable panel, as disclosed in the aforementioned Szymonski et al. patent application, and thereafter contacted with the sacrificial top sheet to adhere the removable panel to the sacrificial top sheet.

Turning to FIG. 1, shown is a schematic illustration of a method for making a product of this invention. Shown in FIG. 1A is a clip or stack of interfolded disposable sheets 10. The first or top sheet 12 is the sacrificial top sheet. The clip of interfolded disposable sheets may be C-folded, V-folded, Z-folded, tab-bonded or configured with respect to one another by any means commonly known in the art. In FIG. 1B, shown is an adhesive deposit 15 which is deposited onto the sacrificial top sheet by any suitable means, such as spraying or extrusion. After the adhesive is placed on top of the sacrificial top sheet, the stack is inserted into an appropriate dispensing container or carton 20 shown in FIG. 1C. The dispensing container 20 includes a pair of sides or walls 16 that are contiguous with another pair of sides or walls 18. A bottom wall 14 is present and is in contact with the walls 16 and 18. The interfolded sheets contained within the container generally rest upon the bottom wall 14 in this embodiment. Also contiguous with the walls 16 and 18 is a dispensing wall or top wall 21. The top wall 21 includes a removable panel 22. The removable panel 22 may be any shape and may flanked by a pair of finger openings 26 which enable the user to easily grasp and remove the removable panel by tearing along the lateral perforations 24. In general, the dispensing container 10 can be made from various materials. For instance, the container can be made from paperboard or cardboard. Alternatively, the container can be made from plastic films, such as thermoplastic films. Materials used to form the walls of the container can be rigid or flexible.

Figure 2:
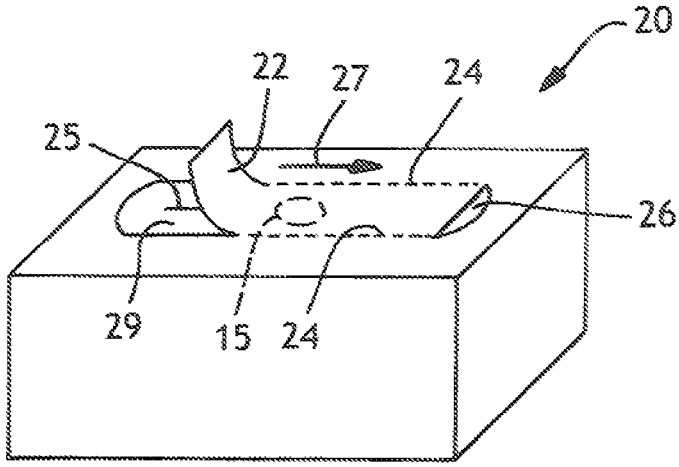
FIG. 2 is a perspective view of the product illustrated in FIG. 1, showing the tissue container partially opened.

FIG. 2 illustrates the product of FIG. 1C as the removable panel 22 is being removed from the container by pulling in the direction of the arrow 27. As shown, removal of the removable panel exposes a dispensing slit 25 within a plastic film 29 that covers the opening created by removal of the removable panel. As previously mentioned, the dispensing slit facilitates pop-up dispensing the sheets one at a time.

FIG. 3A illustrates a product of this invention after removal of the removable panel. As shown, the first usable sheet 30 is partially removed from the container and is exposed in a pop-up fashion. The poly window or film 29 contains a dispensing slit 25, which has a cut-out portion 31 which enables the adhesive on the top surface of the sacrificial top sheet to contact the underside of the removable panel. The size and shape of the cut-out portion can be any size or shape sufficient to allow the adhesive to contact and adhere to the removable panel so the sacrificial top sheet can be removed with the removable panel. To achieve this purpose, the cut-out portion should be slightly larger than the size of the adhesive deposit so that the adhesive deposit does not contact in poly window. (The cut-out portion may be adhered to the removable panel and the sacrificial sheet may be adhered to the underside of the cut-out portion). By way of example, the cut-out portion can suitably be circular with a diameter of about 1 inch or less. It can be located at any point along the dispensing slit, but being centrally located along the length of the slit is particularly suitable.

FIG. 3B illustrates the removable panel 22 and the sacrificial top sheet 12 after the removable panel has been removed from the container.

Figure 3:
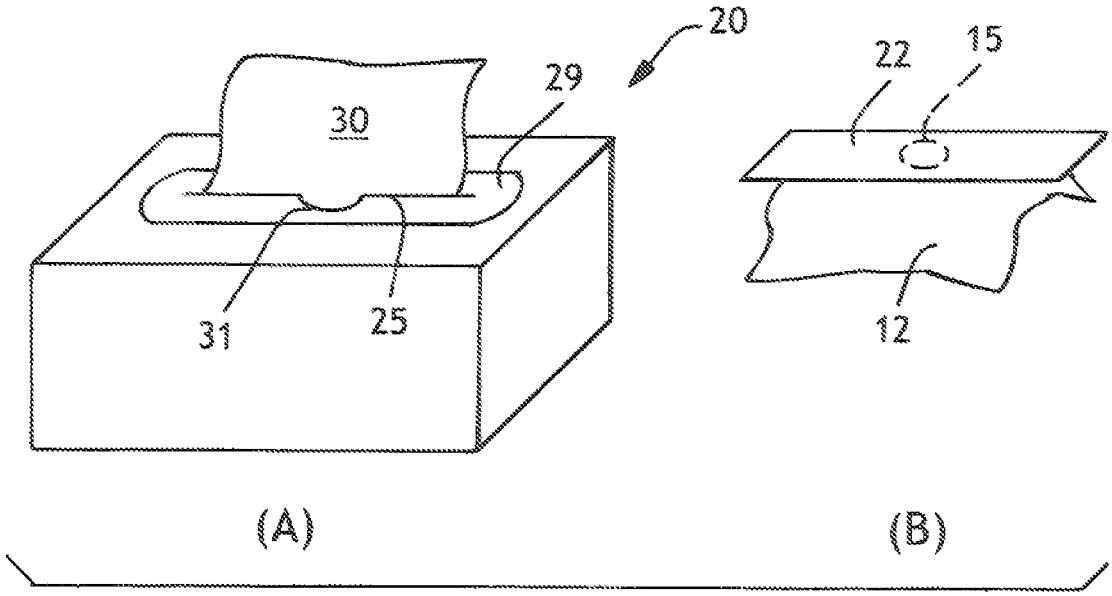
FIG. 3 is a schematic illustration of the tissue product illustrated in FIGS. 1 and 2, showing the first usable tissue partially withdrawn from the container as a result of removing the sacrificial top sheet, which has been removed and remains adhered to the removable panel (surfboard).
Figure 4:
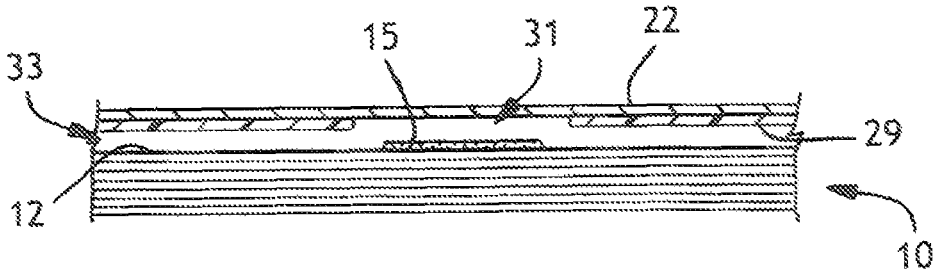
FIG. 4 is a schematic cross-sectional view of a product in accordance with this invention showing the removable panel in relation to the adhesive-containing sacrificial top sheet at the top of the tissue stack.
Figure 5:
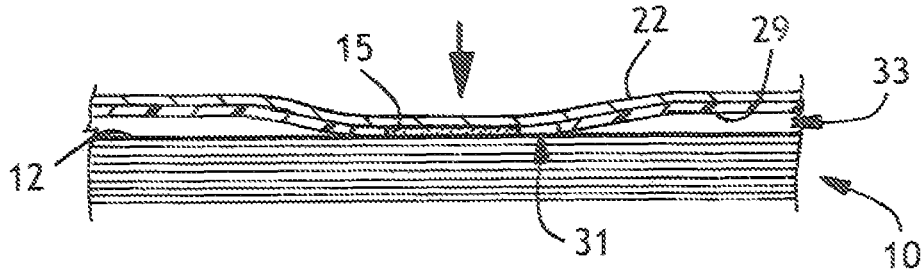
FIG. 5 is a schematic cross-sectional view of the product of FIG. 4 illustrating one way to adhere the removable panel to the sacrificial top sheet by applying inwardly-directed pressure to the removable panel.
Figure 6:
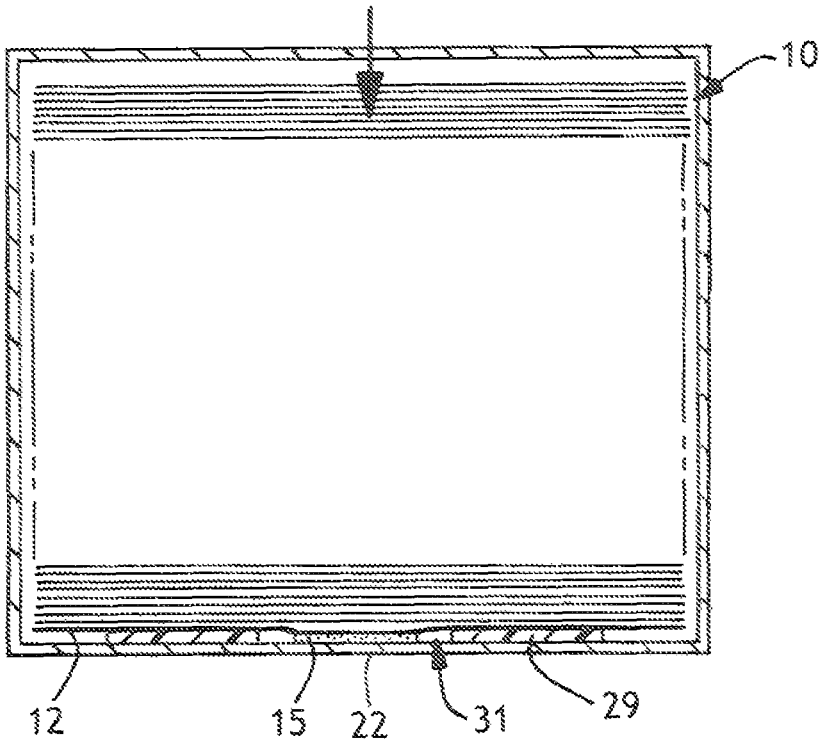
FIG. 6 is a schematic cross-sectional view of the product of FIG. 4 illustrating another way to adhere the removable panel to the sacrificial top sheet by inverting the container.

FIG. 4 is a schematic cross-section of a product of this invention as shown in FIGS. 1-3, further illustrating the relative positions of the adhesive deposit 15 on the sacrificial top sheet 12 and the removable panel. As shown, there is a small air space 33 between the sacrificial top sheet and the poly film 29 which contains the dispensing slit. The poly film contains a cut-out opening 31 which allows the adhesive deposit to contact the removable panel. As shown in FIG. 5, contact can be promoted by depressing or deflecting the removable panel 22 inwardly (in the direction of the arrow). Alternatively, as shown in FIG. 6, contact can be promoted by inverting the product, such that the weight of the stack causes the sacrificial top sheet to deflect into the cut-out opening and contact the removable panel.

Figure 7:
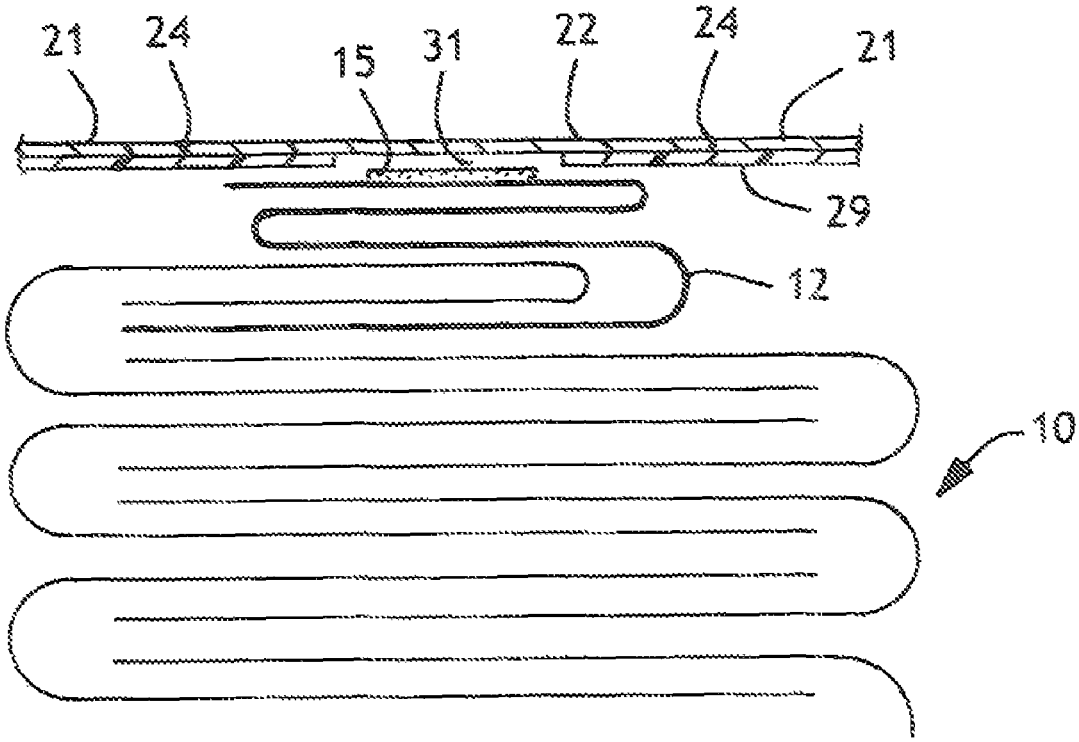
FIG. 7 is a schematic cross-sectional view of one embodiment of an interfolding arrangement of the tissue sheets within the stack.

FIG. 7 is a schematic cross-sectional view of a product of this invention, similar to that shown in FIG. 4, but illustrating an optional interfolding pattern, particularly for the sacrificial top sheet. As illustrated, the top wall 21 of the container contains a removable panel 22 partially defined by lines of perforation 24. Underlying the removable panel is a poly film 29, which contains the dispensing slit. A cut-out 31 in the dispensing slit enables contact between the adhesive deposit 15 on the sacrificial top sheet 12 and the removable pane 221. The majority of the sheets within the stack 10 are C-folded, while the sacrificial top sheet is twice folded upon itself to increase the ease by which the sacrificial top sheet can be adhered to the removable panel.

It will be appreciated that the foregoing description, given for purposes of illustration, is not to be construed as limiting the scope of this invention, which is defined by the following claims and all equivalents thereto.

We claim:

1. A tissue product comprising a clip of interfolded tissues within a container, said container having a top through which the tissues are withdrawn by a user, said top comprising a pop-up tissue dispensing opening and a detachable surfboard overlaying the dispensing opening, said clip of interfolded tissues having an interfolded sacrificial top sheet adhered to the surfboard, said top sheet having a geometric mean tensile strength substantially greater than the geometric mean tensile strength of the other tissues within the clip, wherein upon removal of the surfboard by the user, the sacrificial top sheet is also removed.

2. The product of claim 1 wherein the sacrificial top sheet is a synthetic sheet.

3. The product of claim 1 wherein the sacrificial top sheet is paper.

4. The product of any of the preceding claims wherein the sacrificial top sheet has a geometric mean tensile strength of about 1000 grams or greater per 3 inches of width.

5. The product of claim 1 wherein the sacrificial top sheet has a geometric mean tensile strength from about 1000 to about 20,000 grams per 3 inches of width.

6. The product of claim 1 wherein the sacrificial top sheet has a geometric mean tensile strength from about 1500 to about 15,000 grams per 3 inches of width.

7. The product of claim 1 wherein the sacrificial top sheet has a geometric mean tensile strength from about 2000 to about 15,000 grams per 3 inches of width.

8. The product of claim 1 wherein the sacrificial top sheet is visually distinct from the tissues within the clip.

9. The product of claim 8 wherein the sacrificial top sheet is a different color than the tissues within the clip.

10. The product of claim 8 wherein the sacrificial top sheet contains printed matter.

11. The product of claim 1 wherein the size of the sacrificial top sheet is a different than the size of the tissues.

12. The product of claim 1 wherein the top of the container comprises a poly film having a pop-up dispensing opening therein and the surfboard overlays the poly film dispensing opening.

* * * * *